US007264284B2

(12) United States Patent
Hsu

(10) Patent No.: US 7,264,284 B2
(45) Date of Patent: Sep. 4, 2007

(54) DOOR CATCH

(76) Inventor: Ming-Piao Hsu, No. 17, Lane 50, Jen Te San St., Jen Te Hsiang, Tainan Hsien (TW)

( * ) Notice: Subject to any disclaimer, the term of this patent is extended or adjusted under 35 U.S.C. 154(b) by 0 days.

(21) Appl. No.: 11/237,703

(22) Filed: Sep. 29, 2005

(65) Prior Publication Data

US 2007/0069526 A1 Mar. 29, 2007

(51) Int. Cl.
*E05C 19/00* (2006.01)

(52) U.S. Cl. ..... 292/252; 292/9; 292/DIG. 15; 16/85; 16/82; 16/83

(58) Field of Classification Search ..... 292/252, 292/DIG. 15, DIG. 61, 9, 23, 163; 16/85; 411/525–526
See application file for complete search history.

(56) References Cited

U.S. PATENT DOCUMENTS 406,730 A * 7/1889 Harvie ..... 16/332
2,180,516 A * 11/1939 Gehnrich ..... 292/341.15
2,465,088 A * 3/1949 Gussack ..... 217/60 C
4,121,319 A * 10/1978 Welch ..... 16/66
4,624,092 A * 11/1986 Baginski ..... 52/713
6,116,837 A * 9/2000 Suhle ..... 411/508
6,151,754 A * 11/2000 Chen ..... 16/85
6,584,642 B2 * 7/2003 Hodson ..... 16/85

* cited by examiner

*Primary Examiner*—Brian E. Glessner
*Assistant Examiner*—Kristina R Gluchowski
(74) *Attorney, Agent, or Firm*—Leong C. Lei

(57) ABSTRACT

A door catch includes a back plate having two laterally symmetric sleeves formed on a front face thereof. An elastic check member is mounted in a rear end of each sleeve to replace a conventional screw to confine a steel ball and a spring in the sleeve, so that the spring normally pushes the steel ball forward to partially project from a front open end of the sleeve and the elastic check member backward to firmly close the rear end of the sleeve. The steel balls projected from the two sleeves of the back plate together firmly clamp between them a stop post correspondingly mounted on a movable door leaf.

2 Claims, 1 Drawing Sheet

DOOR CATCH

FIELD OF THE INVENTION

The present invention relates to a door catch, and more particularly to a door catch that includes two elastic check members to enable easier assembling and mounting as well as reduced manufacturing cost of the door catch.

BACKGROUND OF THE INVENTION

In a conventional door catch as shown in FIGS. 1 and 2, there is included a back plate 1 having two laterally symmetric sleeves 11 formed on a front face thereof. A steel ball 2 and a spring 3 are sequentially mounted in each of the two sleeves 11, and a screw 4 is screwed to a rear end of the sleeve 11 to confine the ball 2 and the spring 3 in the sleeve 11, so that the ball 2 is normally pushed by the spring 3 to partially project from a front open end of the sleeve 11. To use the door catch, first fixedly mount the back plate 1 on a wall 10 with fastening elements to correspond to a stop post 6 fixedly mounted on a back of a movable door leaf 20, so that the stop post 6 is clamped by and between the two steel balls 2 partially projected from the front ends of the two sleeves 11 when the door leaf 20 is turned toward the wall 10. The use of the screw 4 to confine the steel ball 2 and the spring 3 in the sleeve 11 is labor and time consuming, and it is possible the screw 4 becomes loosened to finally separate from the sleeve 11. Moreover, the conventional door catch with the above structure must be made of a metal material, and therefore requires a relatively high manufacturing cost.

SUMMARY OF THE INVENTION

A primary object of the present invention is to provide an improved door catch that omits the troublesome screws to enable easier assembling and mounting of the door catch.

Another object of the present invention is to provide an improved door catch that may be made of a plastic material instead of a metal material to thereby reduce the manufacturing cost of the door catch.

To achieve the above and other objects, the door catch of the present invention includes a back plate having two laterally symmetric sleeves formed on a front face thereof. An elastic check member is conveniently mounted in a rear end of each sleeve to replace a conventional screw to confine a steel ball and a spring in the sleeve, so that the spring normally pushes the steel ball forward to partially project from a front open end of the sleeve and the elastic check member backward to firmly close the rear end of the sleeve without the risk of moving out of the sleeve.

To use the door catch of the present invention, the back plate is fixedly mounted on a wall corresponding to a stop post mounted on a movable door leaf, so that the steel balls projected from the two sleeves of the back plate together firmly clamp the stop post between them when the door leaf is turned toward the wall.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
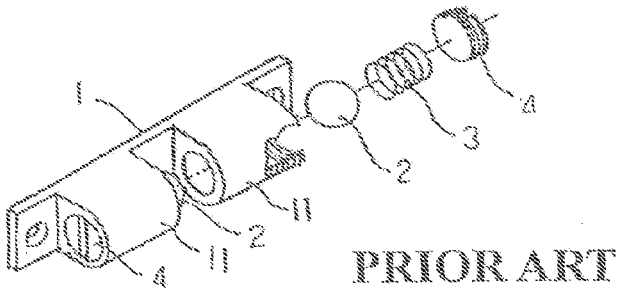
PRIOR ART FIG. 1
FIG. 1 is an exploded perspective view of a conventional door catch.
Figure 2:
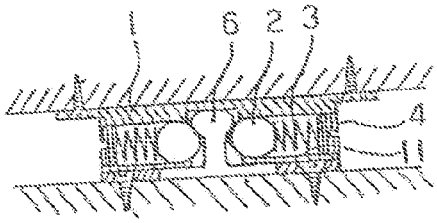
PRIOR ART FIG. 2
FIG. 2 is an assembled sectioned top view of the door catch of FIG. 1.
Figure 3:
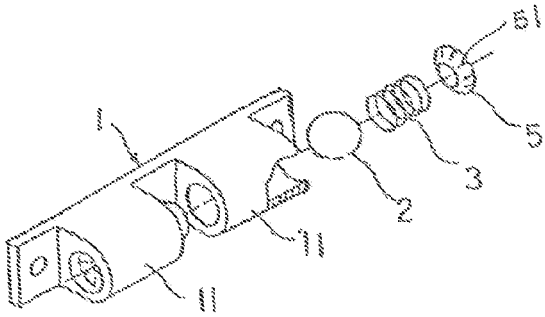
FIG. 3 is an exploded perspective view of a door catch according to the present invention.
Figure 4:
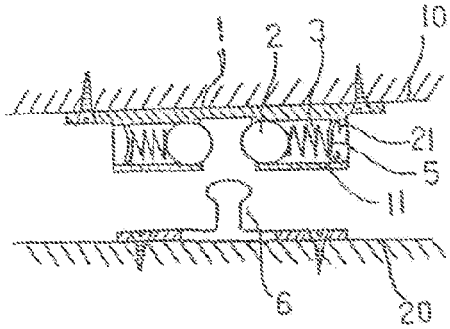
FIG. 4 is an assembled sectioned top view of the door catch of FIG. 3.

Please refer to FIGS. 3 and 4, which are exploded perspective view and assembled sectioned top view, respectively, of a door catch according to the present invention. As shown, the door catch of the present invention includes a back plate 1 having two laterally symmetric sleeves 11 formed on a front face thereof. A steel ball 2 and a spring 3 are sequentially mounted in each of the two sleeves 11. The door catch of the present invention is characterized in that an elastic check member 5 is mounted in a rear end of each of the sleeves 11 to be held in place immediately behind the spring 3, so that the spring 3 on the one hand elastically pushes the steel ball 2 forward to partially project from a front open end of the sleeve 11, and on the other hand elastically pushes the elastic check member 5 backward to firmly press against a rear end of the sleeve 11 without the risk of moving out of the sleeve 11.

According to a preferred embodiment of the present invention, the elastic check member 5 is substantially a concaved circular member with a plurality of radially extended slits 51 spaced along an outer periphery thereof, so that the elastic check member 5 may work like a pawl and could be more easily assembled to the sleeve 11 and held in place without the risk of moving backward to separate from the sleeve 11. It is understood any other deformable member that provides the same checking and fixing function as the elastic check member 5 should be included in the technical scope of the present invention.

In the preferred embodiment of the present invention, each of the sleeves 11 is provided in the rear end with a stop section 21, which is axially compressed when the elastic check member 5 is backward pushed by the spring 3 to press against the stop section 21. The compressed stop section 21 forms a stopper to ensure that the elastic check member 5 is held in place in the rear end of the sleeve 11 without the risk of backward moving out of the sleeve 11.

To use the door catch of the present invention, simply fixedly mount the back plate 1 and a corresponding stop post 6 on a wall 10 and behind a movable door leaf 20, respectively, at two corresponding positions. When the door leaf 20 is turned toward the wall 10, the stop post 6 is tightly clamped by and between the two steel balls 2 that are elastically pushed by the springs 3 to partially project from the front open ends of the two sleeves 11.

Therefore, the door catch of the present invention is easy to assemble and mount without using the easily loosened or separated screws. Moreover, the backplate 1 and the sleeves 11 integrally formed on the back plate 1 of the door catch of the present invention may be made of a material other than metal, such as a plastic material, to reduce the manufacturing cost thereof.

In brief, since the elastic check member 5 may be easily mounted and held in place in the sleeve 11 to prevent the steel ball 2 and the spring 3 from moving out of the sleeve 11, the door catch of the present invention is more convenient for use.

What is claimed is:

1. A door catch, comprising a back plate for fixedly mounting on a wall and having two laterally symmetric sleeves formed on a front face thereof, and a steel ball and a spring sequentially mounted in each of said two sleeves, such that said steel balls are normally pushed forward by said spring to partially project from front open ends of said sleeves for tightly clamping between said two steel balls a stop post, which is mounted on a back of a door leaf corresponding to said back plate; wherein an elastic check member is mounted in a rear end of each of said sleeves to be held in place immediately behind said spring, so that said spring elastically pushes said steel ball forward to partially project from the front open end of said sleeve, and elastically pushes said elastic check member backward to firmly press against the rear end of the sleeve without the risk of backward moving out of said sleeve, said elastic check member is substantially a concaved circular member having a plurality of radially extended slits spaced along an outer periphery of said elastic check member, so that said elastic check member expands when compressed and easily mounts in the rear end of said sleeve without the risk of backward moving out of said sleeves.

2. The door catch as claimed in claim 1, wherein each of said sleeves is provided in the rear end with a stop section, which is axially compressed when said elastic check member is pushed backward by said spring to press against said stop section, and said compressed stop section forming a stopper in the rear end of said sleeves to ensure that said elastic check member is firmly held in place in said sleeves without the risk of backward moving out of said sleeves.

* * * * *